US009216137B2

(12) United States Patent
Galvin

(10) Patent No.: US 9,216,137 B2
(45) Date of Patent: Dec. 22, 2015

(54) MEDICAL ORGANIZER

(71) Applicant: Debbie Galvin, Watkinsville, GA (US)

(72) Inventor: Debbie Galvin, Watkinsville, GA (US)

(73) Assignee: Debbie Galvin, Watkinsville, GA (US)

( * ) Notice: Subject to any disclaimer, the term of this patent is extended or adjusted under 35 U.S.C. 154(b) by 42 days.

(21) Appl. No.: 14/201,837

(22) Filed: Mar. 8, 2014

(65) Prior Publication Data

US 2015/0250676 A1 Sep. 10, 2015

(51) Int. Cl.
*A61J 1/03* (2006.01)
*B65D 21/02* (2006.01)

(52) U.S. Cl.
CPC . *A61J 1/03* (2013.01); *B65D 21/02* (2013.01); *A61J 2205/30* (2013.01)

(58) Field of Classification Search
CPC ..... A61J 1/03; A61J 7/0084; A61J 7/04; A61J 2205/30; B42F 13/0053; B42F 11/00; B65D 21/02; B65D 75/327; B65D 83/00; B65D 83/0445; B65D 2585/56
USPC ..... 206/232, 459.5, 534, 538, 539; 402/73–79
See application file for complete search history.

(56) References Cited

U.S. PATENT DOCUMENTS

| | | | | | |
|---|---|---|---|---|---|
| 2,796,982 | A * | 6/1957 | Volckening | ..... | 206/459.5 |
| 4,345,394 | A * | 8/1982 | Sullivan | ..... | 402/79 |
| 4,553,670 | A * | 11/1985 | Collens | ..... | 206/534 |
| 5,127,756 | A * | 7/1992 | Lumm | ..... | A61B 19/44 402/79 |
| 6,540,082 | B2 * | 4/2003 | Peterson | ..... | 206/534 |
| 6,550,618 | B2 * | 4/2003 | Peterson | ..... | 206/534 |
| 6,575,297 | B2 * | 6/2003 | Schutten | ..... | 206/232 |
| 8,056,724 | B2 * | 11/2011 | Estep | ..... | 206/534 |
| 2004/0050747 | A1 * | 3/2004 | Iso | ..... | 206/534 |

* cited by examiner

*Primary Examiner* — Bryon Gehman

(57) ABSTRACT

Implementations of a medical organizer are provided. In some implementations, the medical organizer may be used to track a patients current medications. In some implementations, the medical organizer may provide both written and visual information (e.g., medication samples, images of the medication) regarding a patient's current medications, allergies, or any other medical information. A medical organizer comprises a body portion having a spine, a flap, a first set of pockets, and a second set of pockets. In some implementations, the first set of pockets may be configured to receive medication therein. In some implementations, one or more of the first set of pockets may also be configured to receive an insert. In some implementations, the second set of pockets may be configured to receive inserts therein. In some implementations, an insert may have thereon patient information (e.g., name, date of birth, address) and/or information related to prescription medications and allergies.

9 Claims, 1 Drawing Sheet

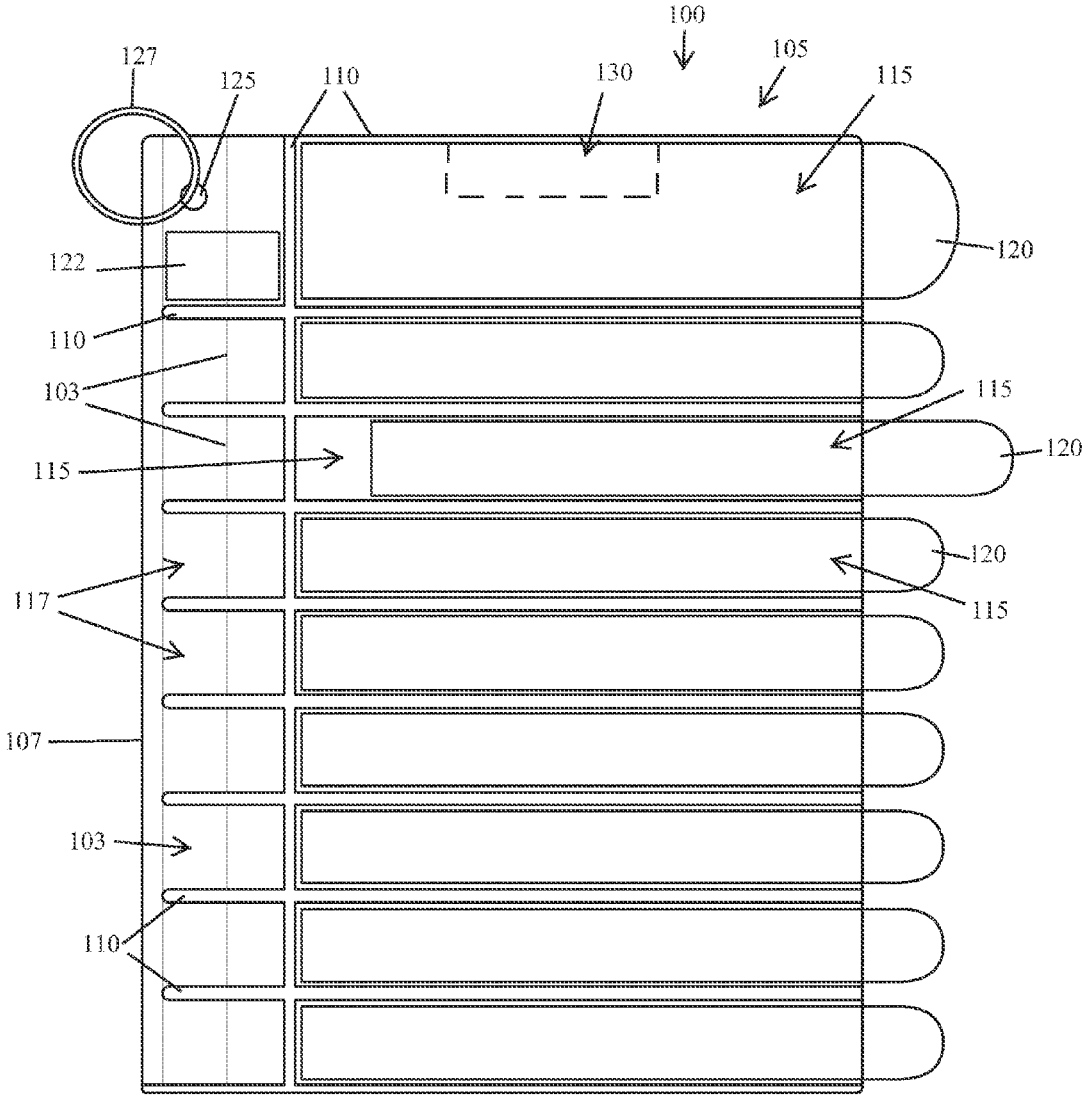
100
105
127
125
110
130
115
120
122
110
103
115
115
120
120
117
115
107
103
110

MEDICAL ORGANIZER

TECHNICAL FIELD

This disclosure relates to implementations of a medical organizer.

BACKGROUND

A medical organizer may be used by or for medical patients to record information provided by physicians or other patient caregivers. Existing medical organizers are typically comprised of a binder having one or more inserts contained therein on which information pertaining to a patient's care is recorded. After use, the medical organizer is filed away. Medical organizers constructed in this fashion do not provide a way for a patient or a patient caregiver to record and display written and visual information (e.g., medication samples) regarding a patient's medications, allergies, or other potentially vital information.

BRIEF DESCRIPTION OF THE DRAWINGS

FIG. 1 illustrates an example medical organizer according to the present disclosure.

DETAILED DESCRIPTION

Implementations of a medical organizer are provided. In some implementations, the medical organizer may be used to track a patients current medications. In some implementations, the medical organizer may provide both written and visual information (e.g., medication samples, preprinted images of the medication) regarding a patient's current medications, allergies, or any other medical information.

A medical organizer comprises a body portion having a spine, a flap, a first set of pockets, and a second set of pockets. In some implementations, the first set of pockets may be configured to receive medication therein. In some implementations, one or more of the first set of pockets may also be configured to receive an insert. In some implementations, the second set of pockets may be configured to receive inserts therein. In some implementations, an insert may have thereon patient information (e.g., name, date of birth, address, or other identifying information) and/or information related to prescription medications and/or allergies To use the medical organizer of the present disclosure, a patient's name and/or other identifying information may be initially written on an insert and secured within the pocket located at the top of the body portion. Next, information regarding the patient's prescription(s) may be written on an insert(s) and placed within a pocket. This step is repeated until the number of pockets or prescriptions is exhausted. Alternatively, in some implementations, two or more medical organizers may be secured together by inserting a ring through the opening of each medical organizer. In this way, additional information regarding a patient's prescription medication may be organized. Next, in some implementations, in a pocket adjacent the pocket having an insert identifying information pertaining to the medication, a sample of the medication (e.g., pill, capsule, tablet, etc. . . . ) may be placed. In this way, the medication may serve as a visual identifier for the medication described on the adjacent insert. In some implementations, patient allergy information or other vital information may be recorded on an insert and secured within a pocket. In some implementations, an insert having an image of the medication may be placed within a pocket in place of an actual sample of the medication.

In this way, a person's medication information can be made readily available to patient care providers. Also, a person taking multiple medications may have visual verification of a medication identified on the medical organizer. Further, the medical organizer may allow a patient to track personal medications.

FIG. 1 illustrates an example medical organizer 100 according to the present disclosure. In some implementations, the medical organizer 100 may be used to track a patient's current medications. In some implementations, the medical organizer 100 may provide both written and visual information (e.g., medication samples, preprinted images of the medication) regarding a patient's current medications, allergies, or other medical information.

As shown in FIG. 1, in some implementations, a medical organizer 100 comprises a body portion 105 having a spine 107, a flap 103, pockets 117, and a second set of pockets 115. In some implementations, the first set of pockets 117 may be configured to receive medication therein. In some implementations, one or more of the pocket 117 may also be configured to receive an insert 122. In some implementations, the second set of pockets 115 may be configured to receive inserts 120 therein. In some implementations, an insert 120, 122 may have thereon patient information (e.g., name, date of birth, address, or other identifying information) and/or information related to prescription medications and/or allergies In some implementations, an opening of a pocket 117 may be covered over by a flap 103 of material which may be formed from the body portion 105 of the medical organizer (see, e.g., FIG. 1). In this way, a pill or insert 122 contained therein may be prevented from falling out of the pocket 117. In some implementations, a flap 103 may extend the height of the body portion 105 to cover the opening of each of the pockets 117 located adjacent the spine 107 of the medical organizer 100 (see, e.g., FIG. 1). In some implementations, a flap may extend the height of the body portion on one or more sides to cover the opening of each of the pockets one or more sides, respectively, of the body portion 105.

In some implementations, the body portion 105 of the medical organizer 100 may include a plurality of seams 110 to create pockets 115,117 of varying sizes. In some implementations, seams 110 are created by fusing two layers of material together at a given position on the body portion 105 (see, e.g., FIG. 1). One of ordinary skill in the art would know how to make a seam 110 to achieve the functions of the present disclosure. In some implementations, the body portion 105 comprises a plurality of seams extending width-wise to define rows a set of pockets.

In some implementations, a pocket may be square. In some implementations, a pocket may be rectangular. In some implementations, a pocket may be any shape suitable for use as part of a medical organizer 100. In some implementations, a pocket 117 may be configured to receive a pill therein. In some implementations, a pocket may 115 be configured to receive an insert 120 therein. In some implementations, a pocket 117 configured to receive medication therein may be located adjacent to a pocket 115 configured to receive an insert 120 therein (see, e.g., FIG. 1). In this way, the medication may provide a visual indicator of the medication identified on the adjacent insert 120. In some implementations, the medical organizer 100 may be comprised of nine sets of pockets 115, 117, wherein a set may include a pocket 115 configured for an insert 120 and a pocket 117 configured for sample medication (see, e.g., FIG. 9). In some implementations, the medical organizer 100 may have more than nine, or less than nine, sets of pockets. In some implementations, the body portion 105 comprises a plurality of seams extending width-wise to define rows for a set of pockets 115, 117.

In some implementations, an insert 120, 122 may be configured to fit within a pocket 115, 117, respectively (see, e.g., FIG. 1). In some implementations, an insert may be shaped like a square. In some implementations, an insert may be shaped like a rectangle. In some implementations, an insert may be any shape suitable for insertion into a pocket of the medical organizer 100. In some implementations, an insert 120 may fit within a pocket 115. In some implementations, an insert 120 may be of sufficient length that it extends from a pocket 115 when secured therein (see, e.g., FIG. 1). In this way, a user may be able to easily remove an insert 120. In some implementations, an insert may have a surface suitable for writing on. In some implementations, an insert may be manufactured from paper. In some implementations, an insert may be manufactured from cardboard. In some implementations, an insert may be manufactured from any material suitable for writing and/or printing on. In some implementations, an insert may have a preprinted message, trademark, logo, or other indicia, thereon. In some implementations, an insert may have a designated place to write a patients name thereon. In some implementations, an insert may have a designated place to write identifying information regarding prescription medication, for example, name of the medication, prescribing doctor, dosage information, etc., or any other relevant information. In this way, the medical organizer 100 may be used to track a patient's current medications. In some implementations, and insert may be used to alert a caregiver to known patient allergies, current medical consider, or any other vital information. In some implementations, an insert may have an image of a medication thereon.

In some implementations, a magnet 130 may secured to the backside of the body portion 105 of a medical organizer 100 and used to secure it to a magnetic surface (see, e.g., FIG. 1).

In some implementations, the body portion 105 may have an aperture 125 therethrough (see, e.g., FIG. 1). In some implementations, the aperture 125 may be located adjacent the spine 107 of the body portion 105. In some implementations, the aperture 125 may have a ring 127 secured therethrough. In this way, the ring 127 may be used to secure the medical organizer 100 to another object. In some implementations, the ring 127 may be used to secure two or more medical organizers 100 together.

In some implementations, the medical organizer 100 may be secured to another surface or object by any method known to those of ordinary skill in the art.

In some implementations, the body portion 105 of the medical organizer 100 may be manufactured of a transparent material. In some implementations, the body portion 105 may be manufactured from a semi-transparent material. In some implementations, the body portion 105 may be manufactured from polypropylene. In some implementations, the body portion 105 may be manufactured from vinyl. In some implementations, the body portion 105 may be manufactured from any suitable material. In some implementations, the body portion 105 may be comprised of one or more pieces of material. In some implementations, the body portion 105 may be a single piece of material.

To use the medical organizer 100 of the present disclosure, a patient's name and/or other identifying information may be initially written on an insert 120 and secured within the pocket 115 located at the top of the body portion 105. Next, information regarding the patient's prescription(s) may be written on an insert(s) and placed within a pocket 115. This step is repeated until the number of pockets or prescriptions is exhausted. Alternatively, in some implementations, two or more medical organizers 100 may be secured together by inserting a ring 127 through the aperture 125 of each medical organizer. In this way, additional information regarding a patient's prescription medications may be recorded and organized. Next, in some implementations, in a pocket 117 adjacent the pocket 115 having an insert identifying information pertaining to the medication, a sample of the medication (e.g., pill, capsule, tablet, etc. . . . ) may be placed. In this way, the medication may serve as a visual identifier for the medication described on the adjacent insert 120. In some implementations, patient allergy information, medical conditions (e.g., allergy information, current aliments, susceptibilities, etc. . . . ), or other vital information may be recorded on an insert and secured within a pocket 120. In some implementations, an insert having an image of the medication may be placed within a pocket 117 in place of an actual sample of the medication. In some implementations, a medical organizer 100 may be provided to a patient care provider (e.g., a physician, nurse, hospital, treatment facility, or caregiver).

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A medical organizer comprising:

a body portion having a plurality of rows wherein each row has a first pocket and a second pocket, wherein the first pocket of each row is configured to receive a dose of medication therein through an open upper end, the first pocket is adjacent to a sealed spine of the body portion, the sealed spine extending a length of one side edge of the body portion from a top edge to a bottom edge of the body portion, and a second pocket adjacent to the first pocket of each row, the second pocket having an open end on a side edge of the body portion opposite to the spine, the open end of the second pocket configured to receive a removable information insert there through.

2. The medical organizer of claim 1 further comprising at least one removable insert, each removable insert configured to record information related to a patient's medication and configured to be inserted into the second pocket of one said row.

3. The medical organizer of claim 2, wherein each respective said removable insert is longer than the second pocket configured to receive the insert, and the insert is configured to protrude from the second pocket.

4. The medical organizer of claim 2, wherein each removable insert provides a surface suitable for writing thereon.

5. A method of using the medical organizer of claim 2, the method comprising writing information regarding a medication on one of the at least one removable insert, placing the one removable insert into one said second pocket and placing a sample of the medication identified on the said one removable insert into the first pocket adjacent the one said second pocket.

6. The medical organizer of claim 1, wherein the medical organizer further comprises a removable ring and the body portion further comprises an aperture wherein the aperture is configured to receive the ring therein.

7. The medical organizer of claim 1, wherein the body portion further comprises respective flaps of material, each flap configured to fold over and thereby cover one of the first pockets, the opening of each first pocket configured to receive medication there through.

8. The medical organizer of claim 1, wherein the medical organizer further comprises a magnet secured to a back of the body portion.

9. The medical organizer of claim 1, further comprising one said first pocket having a dose of medication therein, and the corresponding second pocket, of the same row as the one said first pocket, having a removable insert in the second pocket and provided with information pertaining to the said dose of the medication.

* * * * *